US005224594A

United States Patent [19]

Hou

[11] Patent Number: 5,224,594

[45] Date of Patent: Jul. 6, 1993

[54] ASSEMBLY FOR HOLDING DESK EQUIPMENT

[76] Inventor: Chiel Hou, F.4. No. 291. Sec. 5, Chung Hsiao E. Road. Taipei. Taiwan

[21] Appl. No.: 912,395

[22] Filed: Jul. 13, 1992

[51] Int. Cl.[5] ..... B65D 85/28

[52] U.S. Cl. ..... 206/214; 206/224; 206/371; 220/23.4; 220/23.83

[58] Field of Search ..... 206/223, 214, 215, 224, 206/225, 371, 581, 823; 220/23.4, 23.83

[56] References Cited

U.S. PATENT DOCUMENTS

| | | | |
|---|---|---|---|
| 910.753 | 1/1909 | Weaver | 206/215 |
| 2.960.219 | 11/1960 | Bielan | 206/215 |
| 3.327.688 | 6/1967 | Smith | 206/214 |
| 3.506.324 | 4/1970 | Fristedt | 206/224 |
| 4.406.368 | 9/1983 | Hermes | 206/214 |
| 4.570.793 | 2/1986 | O'Neal et al. | 206/214 |
| 4.696.399 | 9/1987 | Windorski | 206/215 |
| 4.941.576 | 7/1990 | Sugarman et al. | 206/214 |
| 4.953.696 | 9/1990 | Huang | 206/214 |
| 4.964.519 | 10/1990 | Sugarman et al. | 206/214 |
| 5.040.681 | 8/1991 | Grusin | 206/371 |

*Primary Examiner*—Jimmy G. Foster

*Attorney, Agent, or Firm*—Lowe, Price, LeBlanc & Becker

[57] ABSTRACT

An assembly for holders of office desk-type utensils or equipment is described. An interchangeable base plate is provided which is essentially rectangular having an open top with tabs and slots on the sides therefor for interconnection and a channel around the upper edge with a depending ridge. The base plates then can be stacked or interconnected in a horizontal array. A pen holder, a hardware box, and a stamp box are provided which interchangeably fit in the rectangular base. A second base member is provided having the same type of tabs and slots but more narrowly dimensioned to receive a disk mounting box.

1 Claim, 10 Drawing Sheets

ASSEMBLY FOR HOLDING DESK EQUIPMENT

The prosperity of industry and business promotes economic development but also the quality of human life. In order to be comfortable people require convenient, pretty and practical improvements.

People can derive great pleasure from elegant stationery in a working environment. For some time efforts have been directed to the variety and convenience of stationery itself. Packaging or dispensing boxes have not been developed, however. For example, penholder, disk and hardware stationery boxes are normally separate boxes that take up space on a desk. Combined use of one box can conserve space. For example, a ruler can be stored in a penholder, and small hardware stationery can be stored in a drawer for future use.

While stationery has been improved in its usage, improvement is needed in storage space application. What is needed is one storage structure with multiple uses and compartments. This invention is an assembly for solving the space problem which is practical to use.

SUMMARY OF THE INVENTION

An assembly is provided which is composed of hardware stationery box, penholder, memo pad stand, stamp box, disk box (tape box) etc. which makes space usage flexible and overlapping. The sides use a tab and slot for vertical assembly; and for making an inward convex portion for perpendicular overlapping. The purpose is to provide a beautiful, practical, and flexible in space, multi-functional stationery assembly.

BRIEF DESCRIPTION OF THE DRAWINGS

The following is a brief description of the drawings wherein.

DETAILED DESCRIPTION OF THE PREFERRED EMBODIMENT

Figure 1:
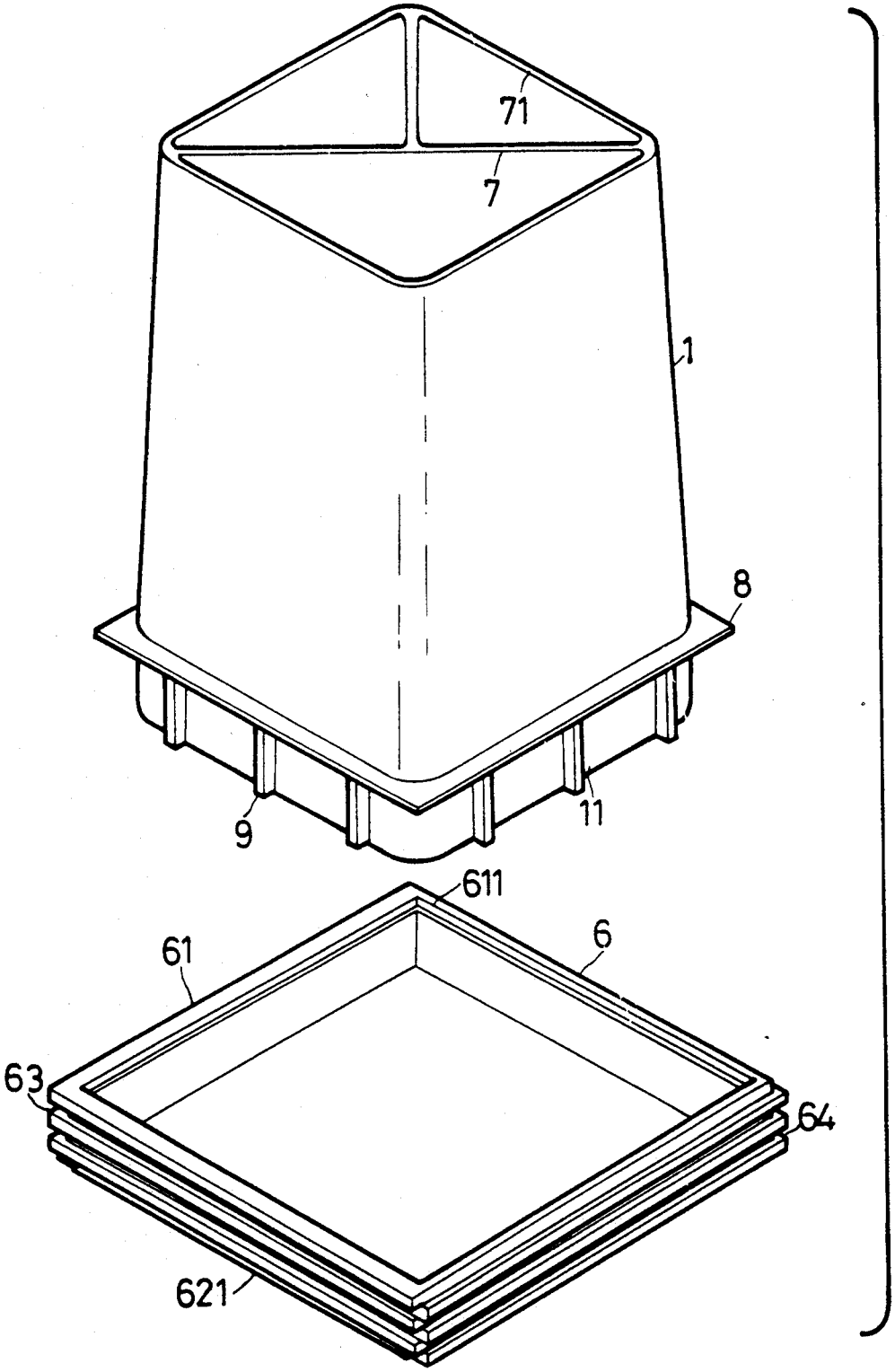
FIG. 1 is a perspective exploded view of the pen holder of this invention.
Figure 2:
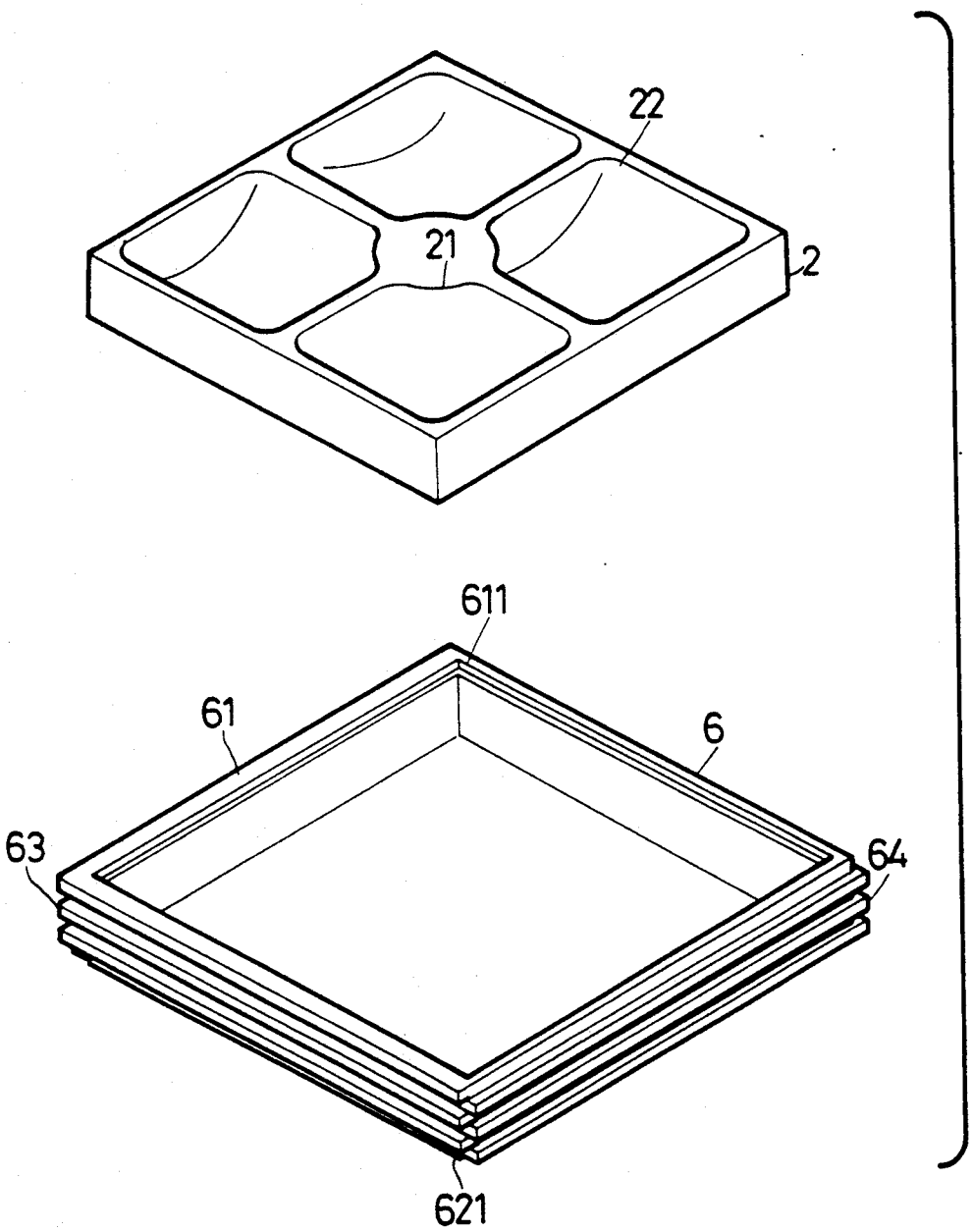
FIG. 2 is an exploded perspective view of the hardware box of this invention.

With attention to the drawings, the invention is composed of a penholder (1), a hardware box (2), a memo pad stand (3), a stamp box (4), a disk box (tape box) (5), and base plate (6) for each. Penholder (1) is a hollow rectangular in cross section member. The bottom (11) is bigger than the top (12) and the inside has two vertical partitions (7) whose height is that of penholder (1). These two partitions (7) are put into penholder (1) to form three triangular compartments (71). The bottom (11) of the penholder (1) mounts a flange plate (8) around the penholder's (1) sides. Spacers (9) are provided below plate (8) and also extend around the sides. Penholder (1) on plate (8) then rests in base 6.

Hardware box (2) is rectangular in shape and has a round partition (21) in the center which divides the inner part into four compartments around edge (22) for receiving paper clips, drawing pin and the like.

Figure 3:
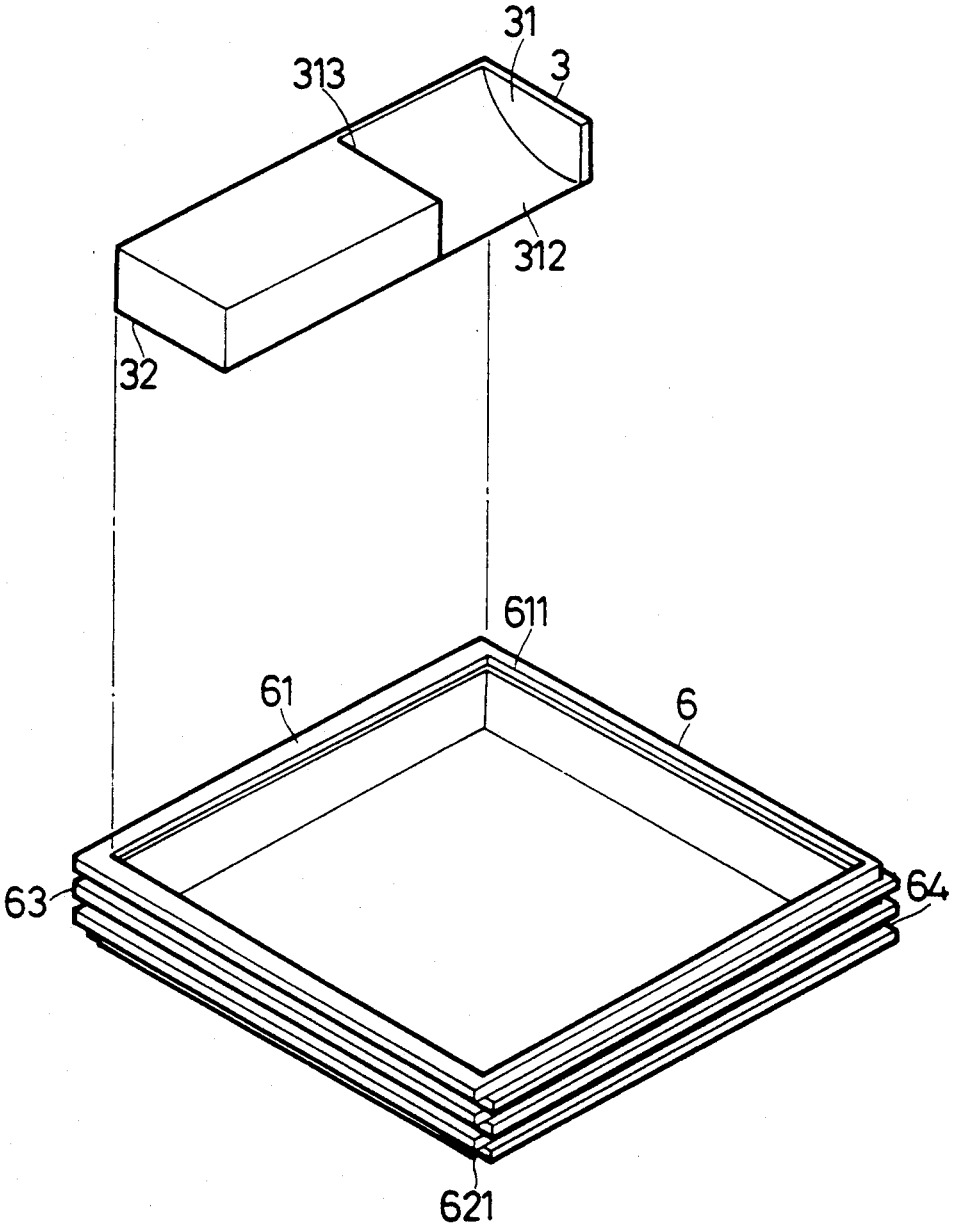
FIG. 3 is a perspective exploded view of the memo pad stand.
Figure 4:
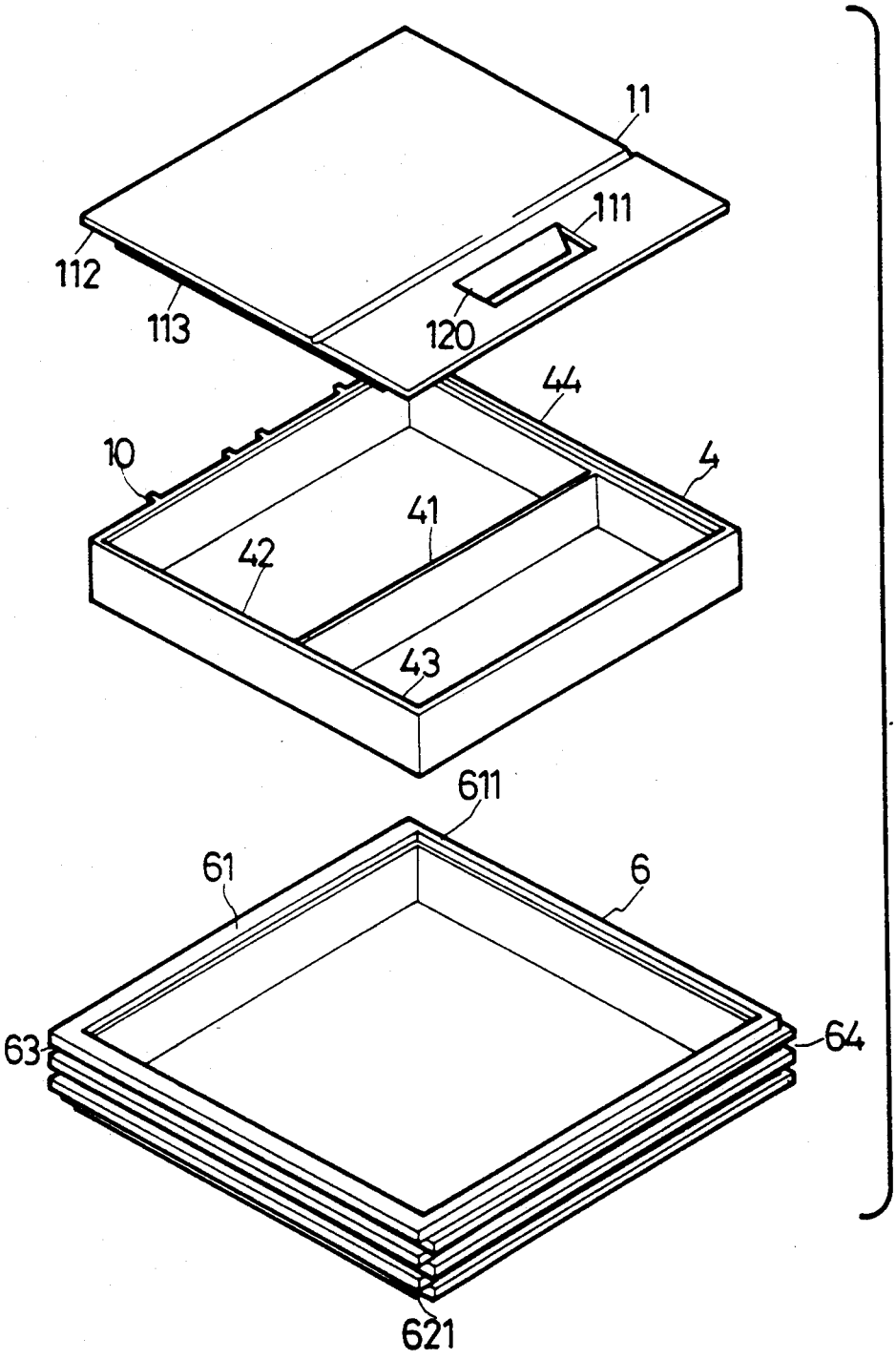
FIG. 4 is an exploded perspective view of the seal or stamp box.
Figure 5:
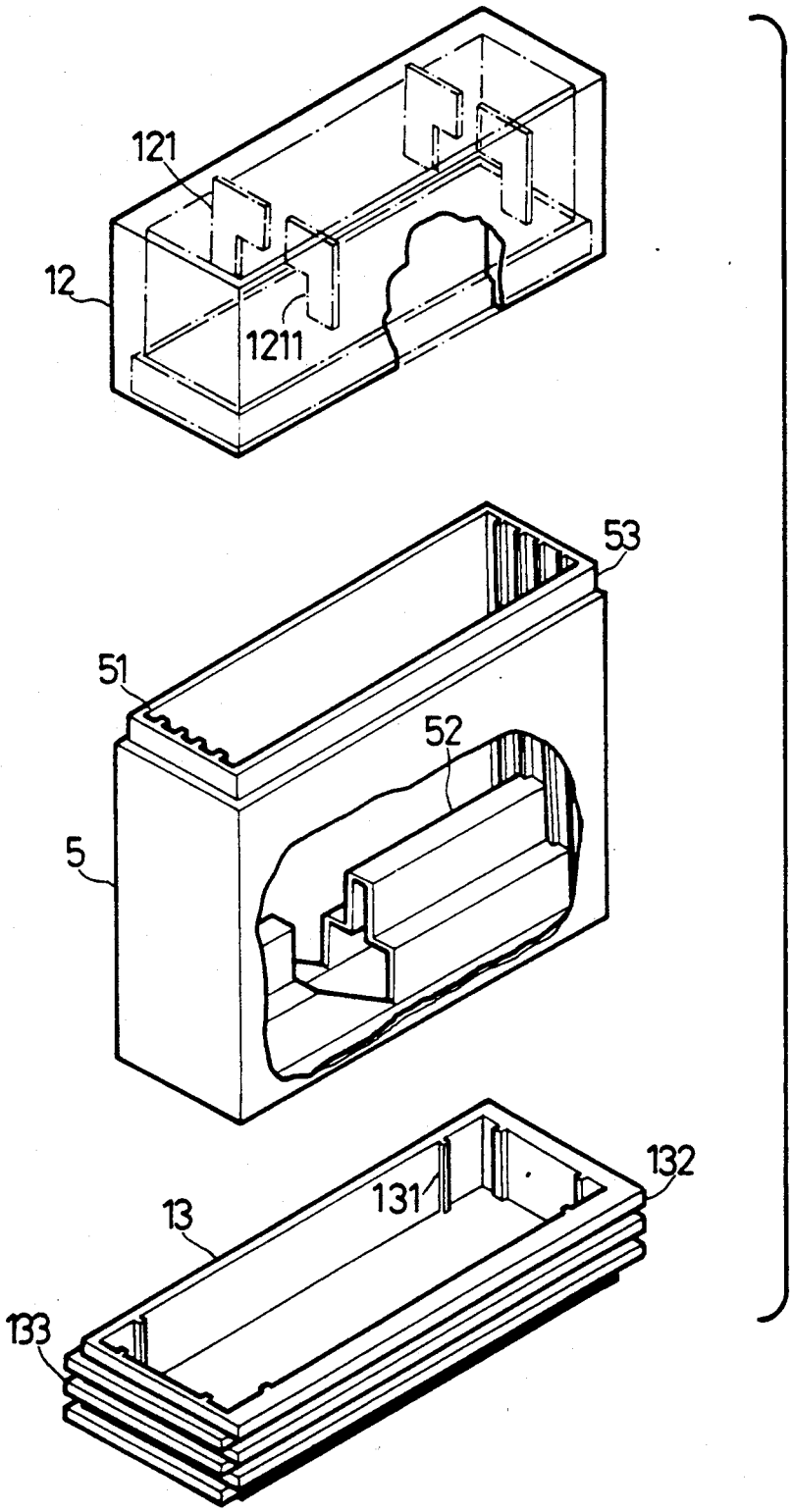
FIG. 5 is an exploded perspective view of the disk box.
Figure 6:
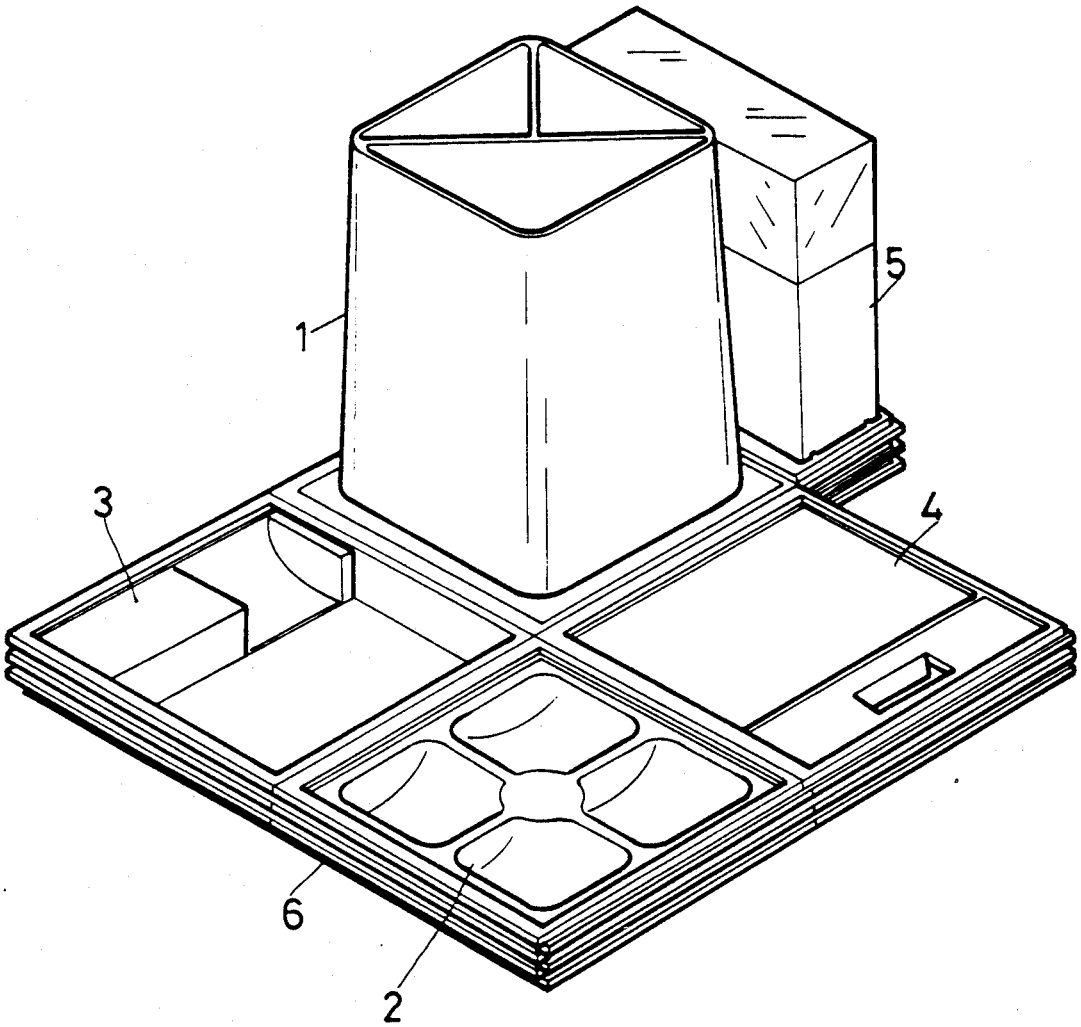
FIG. 6 is a perspective view of an assembly of the interlocking boxes of this invention.
Figure 7:
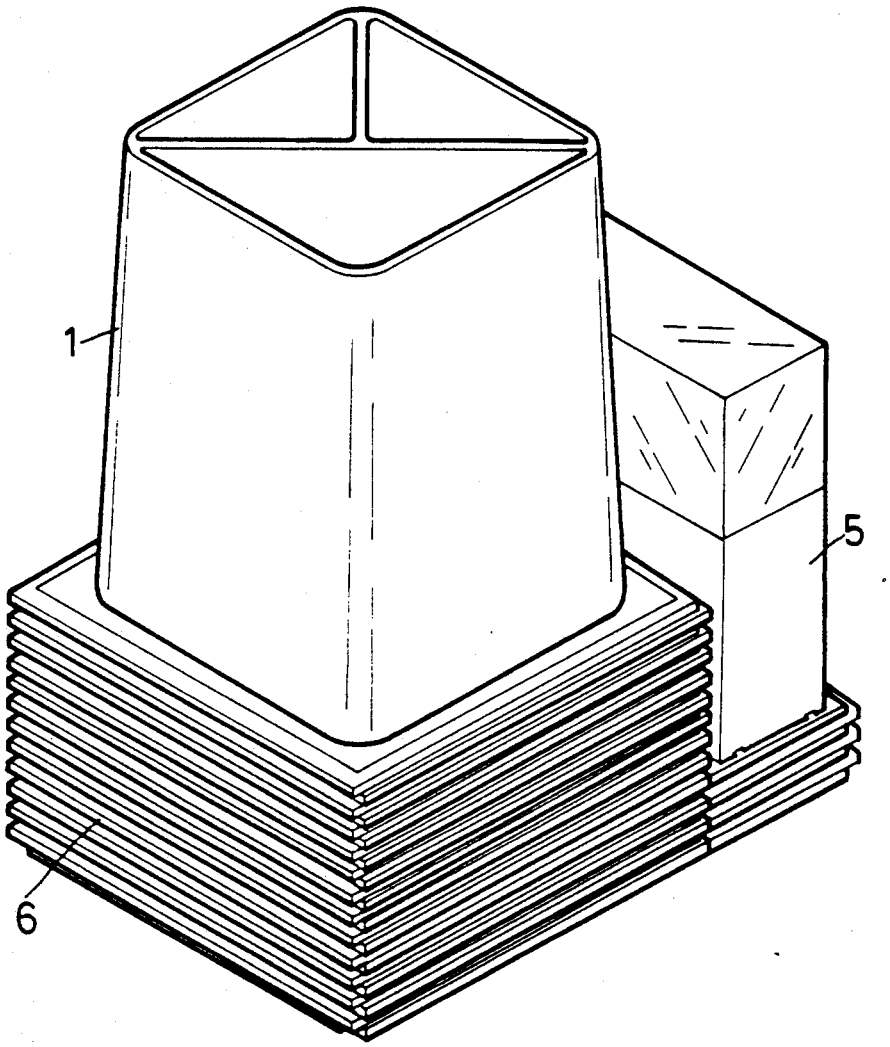
FIG. 7 is a perspective view of a vertical array of an embodiment of the assembly of this invention.
Figure 8A:
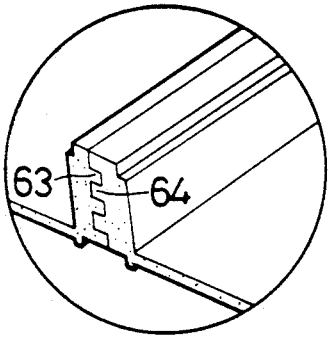
FIG. 8A is a fragmentary detail view at circle 8 of FIG. 8.
Figure 8:
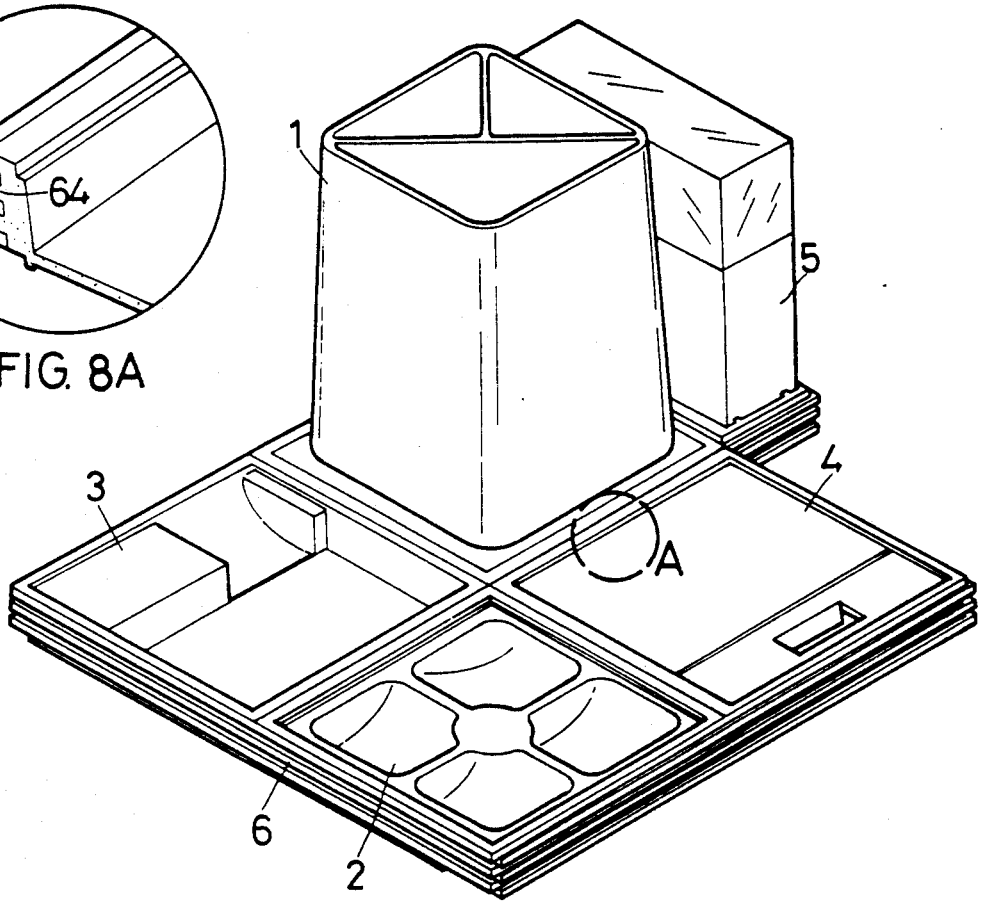
FIG. 8 is a view similar to FIG. 6
Figure 9:
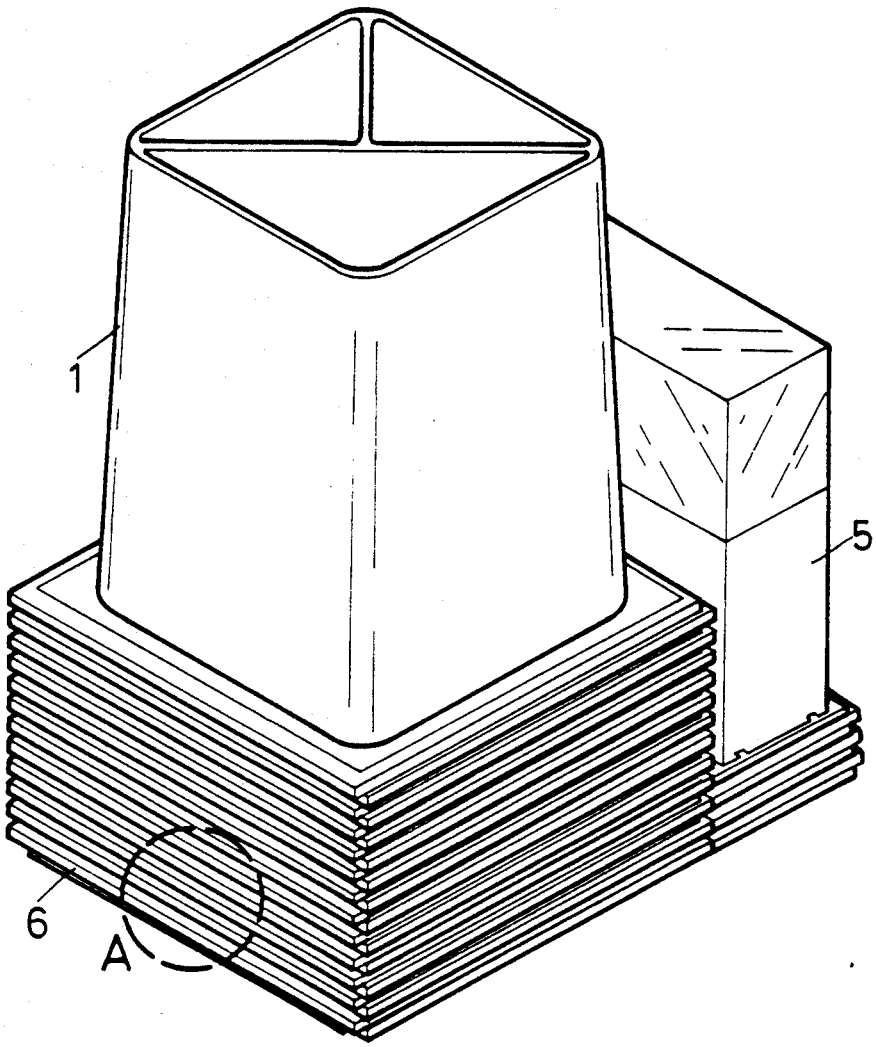
FIG. 9 is a view similar to FIG. 7
Figure 9A:
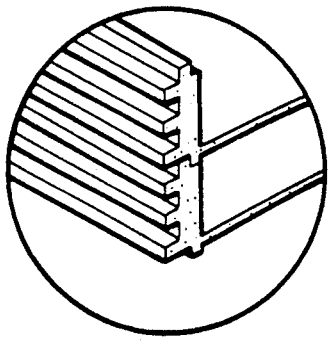
FIG. 9A is a fragmentary cross-sectional view of the detail at circle A of FIG. 9.
Figure 10:
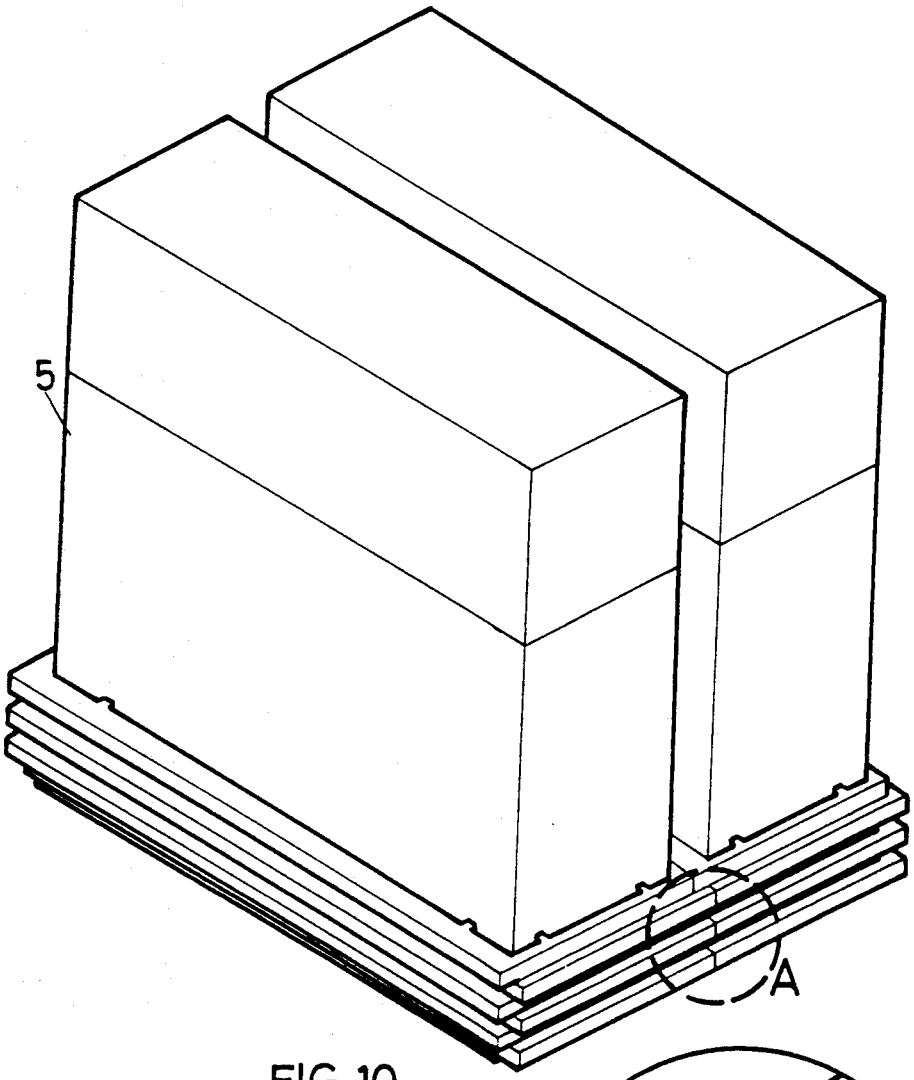
FIG. 10 is a perspective view of another embodiment of this invention including a pair of disk boxes and FIG. 10A is a detailed cross-sectional fragmentary view at circle A of FIG. 10.
Figure 10A:
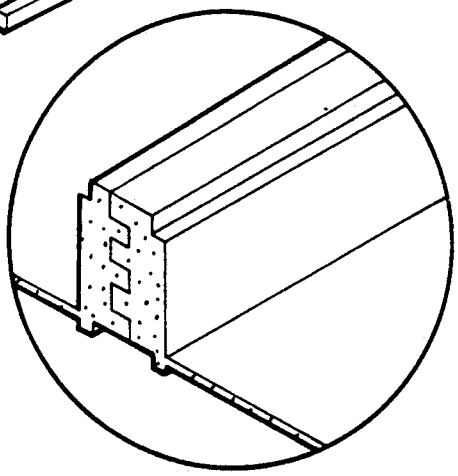

Memo pad stand (3) is oblong. As shown in FIG. 3, it has an end wall (31), and another wall (313) at the opposite end. These two walls are connected by a sloping bottom for conveniently removing pads. The other end of the memo pad stand (3) is a hollow enclosure (32) closed by two perpendicular flat surfaces.

As for stamp box (4) a hollow rectangular tray with an upward opening and a partition (41) therein which is lower than the height of box (4). It divides into storage area (42) and area (43). The seal box (4) has spacer ribs (10) for stable installation in base (6). There are two convex channels on (44) the top of the box (4) to fit the box cover (11) which is a rectangular flat surface as is the seal box (4). It has one rectangular slot (111) united with one inclined plate (120) for convenient opening by the user. There are tabs (113) in the three sides for mounting in the channel (44) of box (4).

Disk box (5) is an oblong hollow body with an upward opening. Inside it has two inward convex guides (51) at opposite sides. At the bottom it has a stair-like support (52). These guides (51) and stair-like support (52) divide the disk box (5) into storage areas. The disk boxes' top has a recess (53) to receive disk box cover (12) which is an oblong hollow body with a downward opening. Two partitions (121) with suitable openings (1211) are provided therein to mount disks. The bottom of disk box (5) is placed within the disk box stand (13) which is a rectangular hollow body opening upward. Spacers (131) are provided inside to receive the disk box (5) within disk box stand (13). The outward sides of the disk box stand have convex tabs (132), and concave uniting slots (133). The convex uniting tabs (132) and concave uniting slots (133) are for connecting two disk box stands (13).

The base plate (6) as shown in FIGS. 1–4 is a rectangular body with an upward opening. The top (61) has an inward channel (611), and a depending ridge (621) at the bottom. The inward channel (611) is dimensioned to receive the rectangular convex ridge (621) to stack a plurality of base plates (6). The outward connecting sides of the base plates (6) have convex uniting ridges (63) and concave uniting slots (64). The convex uniting ridges (63) are dimensioned to fit in the uniting slots for a horizontal assembly between different base plates (6). The base plates (6) may also be interchanged between the hardware stationery box (2), memo pad stand (3) and stamp box (4).

At the time of assembly, the penholder (1) with the base plate (6)the card is fitted in the bottom of penholder in the base plate through fitting the plate (8) of penholder (1) and the inward channel (611) of base plate (6). After such assembly, the memo pad stand (3) can be put perpendicularly into the base plate (6) and memo pad (3) can be taken out easily through designed sloping surface (312). The stamp box (4) also can be put directly into the base plate (6) and the boxes assembled horizontally uniting convex tabs (63) and uniting slots (64). The base plates (6) also can be staked for storage.

What is claimed is:

1. A desk top work assembly comprising a rectangular pen holder formed as a hollow box having an open top and dividing walls therein; a rectangular stationery hardwarebox having an open top and a center divider with radial partitions to form segments; a rectangular memo pad stand having a sloping base portion for mounting memo pads; and a rectangular stamp box having an open top, and a cover for said box received in the open top thereof, said cover having a slot therein for access to the interior of said box;

each of said rectangular pen holder, hardware box, memo pad stand and stamp box having horizontal dimensions defining a common external width and a maximum length;

four rectangular base plates having four sides and an open top surrounded by a channel having predetermined dimensions to receive therein each of said pen holder, hardware box, memo pad and stamp box and each plate defining a depending ridge also dimensioned to be received in said channel for stacking said plates;

a disk box having an open top and a plurality of partitions therein; a downwardly opening cover adapted to fit over the open top thereof and providing corresponding partitions therein, said disk box and cover being rectangular in horizontal cross-section;

a rectangular base plate for said disk box having four sides and an open top defining a channel adapted to receive said disk box;

the external surfaces of the sides of said base plates having mutually spaced grooves defining alternating tabs and slots dimensioned so that said plates can be horizontally assembled in interlocking relationship with tabs inserted in corresponding adjacent slots.

* * * * *